US008104181B2

(12) United States Patent
Kawaguchi

(10) Patent No.: US 8,104,181 B2
(45) Date of Patent: Jan. 31, 2012

(54) OUTER BLADE FOR RECIPROCATION-TYPE ELECTRIC SHAVER AND METHOD OF PRODUCING THE SAME

(75) Inventor: Tatsuji Kawaguchi, Suita (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 430 days.

(21) Appl. No.: 12/377,071

(22) PCT Filed: Oct. 2, 2007

(86) PCT No.: PCT/JP2007/069254
§ 371 (c)(1),
(2), (4) Date: Feb. 10, 2009

(87) PCT Pub. No.: WO2008/044538
PCT Pub. Date: Apr. 17, 2008

(65) Prior Publication Data

US 2010/0162568 A1 Jul. 1, 2010

(30) Foreign Application Priority Data

Oct. 13, 2006 (JP) ..... 2006-280531

(51) Int. Cl.
*B26B 19/04* (2006.01)

(52) U.S. Cl. ..... 30/346.51; 30/43.92; 76/104.1; 76/116

(58) Field of Classification Search ..... 30/43.9, 30/43.92, 346.51; 76/104.1, 116
See application file for complete search history.

(56) References Cited

U.S. PATENT DOCUMENTS 2,081,694 A * 5/1937 Bruecker ..... 30/43.9
2,234,894 A * 3/1941 Bruecker ..... 72/340
3,216,286 A * 11/1965 Heyek ..... 76/116
3,468,025 A 9/1969 Messinger
(Continued)

FOREIGN PATENT DOCUMENTS

DE 4339918 5/1994
(Continued)

OTHER PUBLICATIONS

English language Abstract of JP 1-227788 A.
Search report from E.P.O., mail date is Oct. 2010.
(Continued)

*Primary Examiner* — Hwei C Payer
(74) *Attorney, Agent, or Firm* — Greenblum & Bernstein P.L.C.

(57) ABSTRACT

Provided are an outer blade for a reciprocation-type electric shaver and a method of producing the outer blade, the outer blade being capable of suppressing a deformation such as wrinkles or an undulation, without adding a new component, to thereby keep a good appearance thereof. A sheet material for forming the outer blade is bent into a shape projecting upward when viewed in the lateral directions. The sheet material has hair introduction holes, the peripheral edge of each hair introduction hole forming a projection section projecting inward beyond the other portion of the sheet material, the end surfaces of a part of the projection sections make contact with a reciprocating inner blade. The sheet material is formed with a deformation suppression section in a specific region not including the projection sections which make contact with the inner blade but including the projection sections which make no contact with the inner blade. The deformation suppression section extends in a direction, the projection sections included in the deformation suppression section being crushed by pressing from the inside of the sheet material.

17 Claims, 6 Drawing Sheets

U.S. PATENT DOCUMENTS

| | | | | | |
|---|---|---|---|---|---|
| 3,714,807 | A | | 2/1973 | S. Grunberger | |
| 3,881,373 | A | * | 5/1975 | Nakamura et al. | 76/104.1 |
| 4,035,914 | A | | 7/1977 | Blume et al. | |
| 4,061,056 | A | * | 12/1977 | Nakamura | 76/104.1 |
| 4,184,250 | A | | 1/1980 | Meijer | |
| 4,493,149 | A | | 1/1985 | Tanahashi et al. | |
| 4,807,365 | A | * | 2/1989 | Bertram et al. | 30/346.51 |
| 4,926,552 | A | * | 5/1990 | Otsuka et al. | 30/43.92 |
| 5,473,818 | A | | 12/1995 | Otsuka et al. | |
| 5,901,446 | A | | 5/1999 | Szymansky | |
| 7,024,775 | B2 | * | 4/2006 | Uchiyama | 30/43.92 |
| 7,730,621 | B2 | * | 6/2010 | Komori et al. | 30/346.51 |
| 2004/0163260 | A1 | * | 8/2004 | Uchiyama | 30/43.92 |
| 2004/0237318 | A1 | | 12/2004 | Uchiyama | |
| 2006/0144193 | A1 | | 7/2006 | Denne | |
| 2007/0175042 | A1 | * | 8/2007 | Okabe | 30/43.92 |

FOREIGN PATENT DOCUMENTS

| | | | | |
|---|---|---|---|---|
| JP | 56-152672 | A | | 11/1981 |
| JP | 56-166874 | A | | 12/1981 |
| JP | 58-055584 | A | | 4/1983 |
| JP | 59 113194 | | * | 6/1984 |
| JP | 63-286180 | A | | 11/1988 |
| JP | 8-8949 | B2 | | 1/1996 |
| JP | 2004-350824 | A | | 12/2004 |
| JP | 2006-501034 | A | | 1/2006 |
| WO | 99/14019 | | | 3/1999 |
| WO | 2004/030875 | | | 4/2004 |

OTHER PUBLICATIONS

English language Abstract of JP 58-055584 A.
English language Abstract of JP 2004-350824 A.
English Language Abstract of WIPO 2004/030875, which also corresponds to JP 2006-501034.

* cited by examiner

OUTER BLADE FOR RECIPROCATION-TYPE ELECTRIC SHAVER AND METHOD OF PRODUCING THE SAME

TECHNICAL FIELD

The present invention relates to an outer blade for a reciprocation-type electric shaver and a method of producing the outer blade.

BACKGROUND ART

There is conventionally known a reciprocation-type electric shaver which includes an outer blade and an inner blade adapted to laterally reciprocate while riding on the inner surface of the outer blade. Patent Document 1 shows an outer blade formed of a quadrangular sheet material having a large number of hair introduction holes and bent into a shape projecting upward when viewed in the lateral directions (e.g., reverse-U shape). In the sheet material, the peripheral edge of each hair introduction hole forms a projection section embossed inward (i.e., projecting inward beyond the other portion), and an inner blade reciprocates in contact with the end surface of each projection section to thereby cut a hair inserted through the corresponding hair introduction hole.

The outer blade formed of the quadrangular sheet material bent in the shape projecting upward in lateral view has a side portion forming a side surface, and the side portion has such a low rigidity that a deformation such as wrinkles or an undulation tends to be produced in lower-end portions of the side faces. Particularly, an outer blade formed by, in addition to the above bending, bending in a different direction so as to curve the upper edge thereof in an arc when viewed from the front, allows a surplus of the material to be produced on the lower-edge side, which further promote the deformation. The above deformations deteriorate an appearance of the outer blade.

For suppression of the deformations, Patent Document 1 described above and Patent Document 2 show a deformation prevention plate attached to a lower end of the easily-deformed side faces of the sheet material, separately therefrom. However, the addition of the deformation prevention plate increases material expense of the outer-blade and the number of man-hour for assembly, thereby increasing cost.

Patent Document 1: Japanese Patent Laid-Open Publication No. 63-286180

Patent Document 2: Japanese Patent Publication No. 8-8949

DISCLOSURE OF THE INVENTION

It is an object of the present invention to provide an outer blade for a reciprocation-type electric shaver capable of suppressing a deformation such as wrinkles and an undulation in the outer blade, without adding a component such as the deformation prevention plate, to thereby keep a good appearance, and a method of producing the outer blade.

An outer blade for a reciprocation-type electric shaver according to the present invention is formed of a sheet material bent into a shape projecting upward when viewed in the lateral directions. The sheet material has hair introduction holes through the sheet material in the thickness directions thereof, the peripheral edge of each of the hair introduction holes forms a projection section projecting inward beyond the other portion of the sheet material. The end surfaces of a part of the projection sections make contact with an inner blade of the reciprocation-type electric shaver reciprocating to cut a hair inserted through the corresponding hair introduction holes. Furthermore, the sheet material is formed with a deformation suppression section in a specific region not including the projection sections which make contact with the inner blade but including the projection sections which make no contact with the inner blade. The deformation suppression section extends in a direction, and the projection sections included in the deformation suppression section are crushed by pressing the projection sections from the inside of the sheet material.

A method of producing an outer blade for a reciprocation-type electric shaver according to the present invention includes: a process of producing a sheet material forming the outer blade, the sheet material having hair introduction holes through the sheet material in the thickness directions thereof, and the peripheral edge of each hair introduction hole forming a projection section projecting inward beyond the other portion of the sheet material; a process of bending the sheet material into a shape projecting upward when viewed in the lateral directions; and a process of forming a deformation suppression section suppressing a deformation of the lower end of the sheet material, in a specific region of the sheet material not including the projection sections which make contact with the inner blade of the reciprocation-type electric shaver but including the projection sections which make no contact with the inner blade. In the process of forming a deformation suppression section, the projection sections included in the region of the deformation suppression section are crushed by pressing the deformation suppression section from the inside of the sheet material.

Herein, "the projection sections are crushed" is not limited to a complete crush of the projection sections, but includes such a crush as to leave a part of the inward projection of each projection section (e.g., such a crush as to incline each projection section by a predetermined angle radially inwardly).

In the above outer blade and method of producing the outer blade, the crush of the projection sections included in the deformation suppression section by pressing them from the inside rigidifies lower-end portions of the outer blade to suppress a deformation such as wrinkles and an undulation in the lower-end portions. Besides, the formation of the deformation suppression section has little effect on the shape of the outer surface of the outer blade, which permits an improvement of the appearance of the outer blade. Furthermore, the suppression of the deformation requires no addition of any separate component, thus involving no cost increase due to the addition.

BEST MODE FOR IMPLEMENTING THE INVENTION

The best mode for implementing the present invention will be below described in detail with reference to the drawings.

Figure 1A:
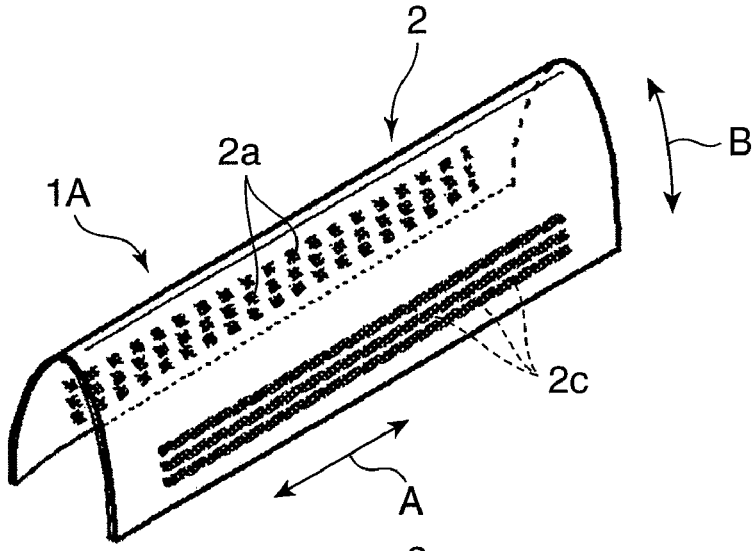
FIG. 1A is a perspective view of an outer blade formed of a sheet material bent only in first directions according to an embodiment of the present invention and FIG. 1B is a perspective view of an outer blade formed of the sheet material bent in the first directions and in second directions according to the embodiment.
Figure 1B:
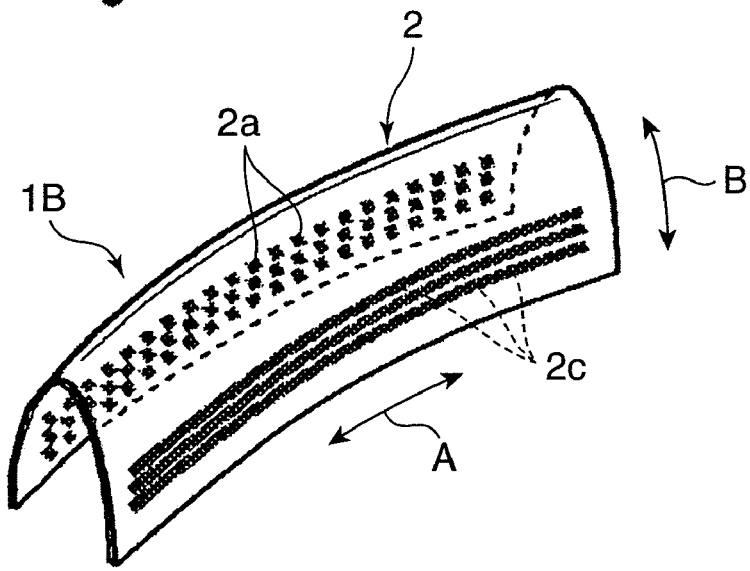
Figure 5:
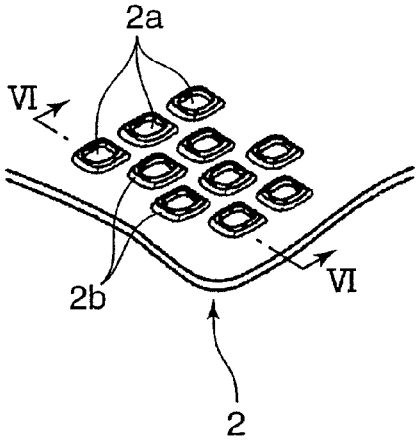
FIG. 5 is an enlarged perspective view showing a main part of the sheet material of FIG. 4.
Figure 6:
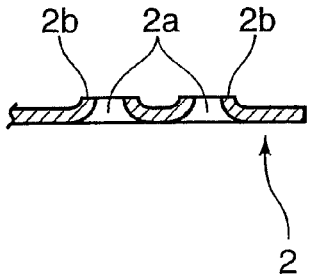
FIG. 6 is a sectional view taken on VI-VI line of FIG. 5.

FIGS. 1A and 1B show outer blades 1A and 1B, respectively, for a reciprocation-type electric shaver according to an embodiment of the present invention. Either of the outer blades 1A and 1B are each formed of a quadrangular sheet material 2 having many hair introduction holes 2*a* arranged vertically and laterally. The peripheral edge of each hair introduction hole 2*a* forms, as shown in FIGS. 4 to 6, a projection section 2*b* embossed inward (upward in FIGS. 4 and 5), in other words, projecting inward beyond the other portion.

Figure 4:
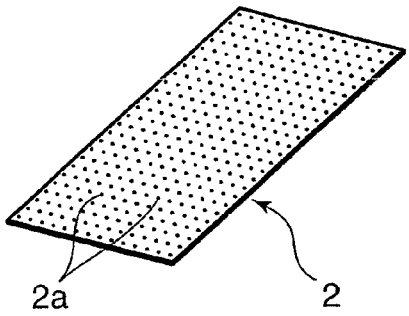
FIG. 4 is a perspective view of a not-yet bent sheet material for forming the outer blade.

The outer blade 1A of FIG. 1A is formed by bending the sheet material 2 originally shaped like a flat plate shown in FIG. 4 into a reverse-U shape, specifically, in such away that the middle thereof projects upward when viewed in a lateral direction (i.e., in a first direction). On the other hand, the outer blade 1B of FIG. 1B is formed by further bending the sheet material 2 bent in the first direction in such a way that the upper edge thereof is curved in an arc when viewed from the front (i.e., in second directions different from the first directions).

Figure 2:
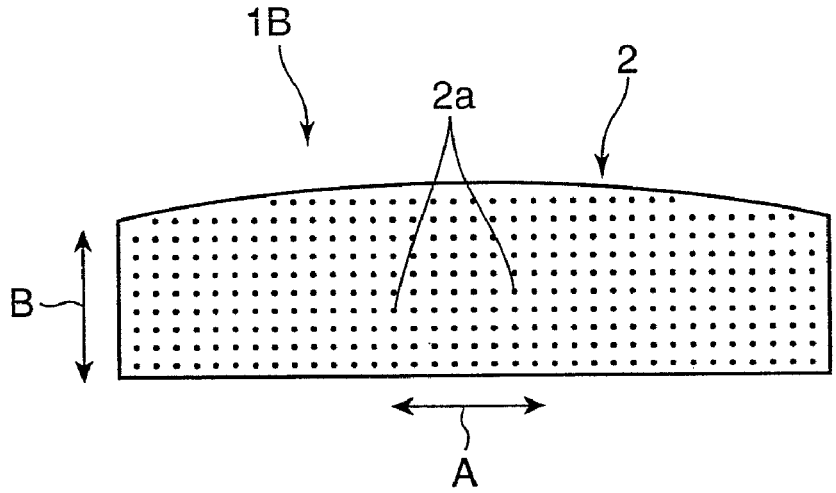
FIG. 2 is a front view of the outer blade shown in FIG. 1B.
Figure 3:
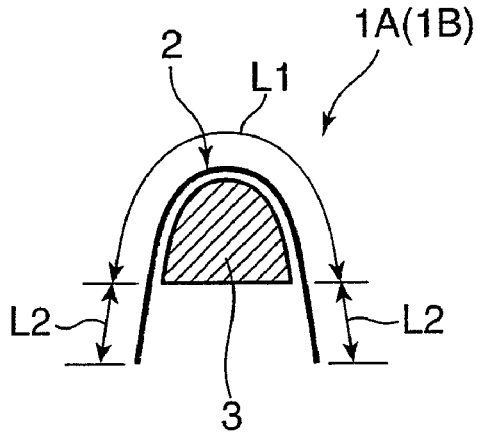
FIG. 3 is a sectional side view of the outer blade shown in FIG. 1B.

Each outer blade 1A, 1B constitutes a reciprocation-type electric shaver in combination with an inner blade 3 shown in FIG. 3. The inner blade 3 reciprocates in a longitudinal direction of the outer blade (in the directions shown by an arrow A of FIG. 2, i.e., laterally with respect to a longitudinal direction of a reciprocation-type electric shaver) in contact with the end surfaces of projection sections 2*b* within a specific region L1 among the projection sections 2*b* of the outer blade 1 while a hair is inserted through each hair introduction hole 2*a*, to thereby cut the hair in collaboration with the end surfaces (as practical outer blades) of the corresponding projection sections 2*b*.

As shown in FIG. 3, the region L1 is a region including a vertex portion of the sheet material 2 except regions L2 near both lower-end portions thereof. In other words, each of the regions L2 near both lower-end portions is a region not including the projection sections 2*b* which make into contact with the inner blade 3 but including the projection sections 2*b* which make no contact with the inner blade 3.

The quadrangular sheet material 2 forming each outer blade 1A, 1B is generally made of a stainless material subjected to quenching. Their dimensions may be suitably set. In general, it is preferable that the thickness is approximately 0.035 mm, and is approximately 0.063 mm when including the embossed sections 2*b* of the hair introduction holes 2*a*. The suitable diameter of each hair introduction hole 2*a* is approximately 0.4 mm and the suitable hole pitch is approximately 0.5 mm.

Also the shape of each hair introduction hole 2*a* may also be suitably set. In general, the hair introduction holes 2*a* formed in the region L1 where the inner surface of the sheet material 2 (i.e., the end surfaces of the projection sections 2*b*) makes contact with the inner blade 3 have a hexagonal shape, while the hair introduction holes 2*a* formed in the region L2 where the inner surface makes no contact with the inner blade 3 have a quadrangular shape.

Figure 7:
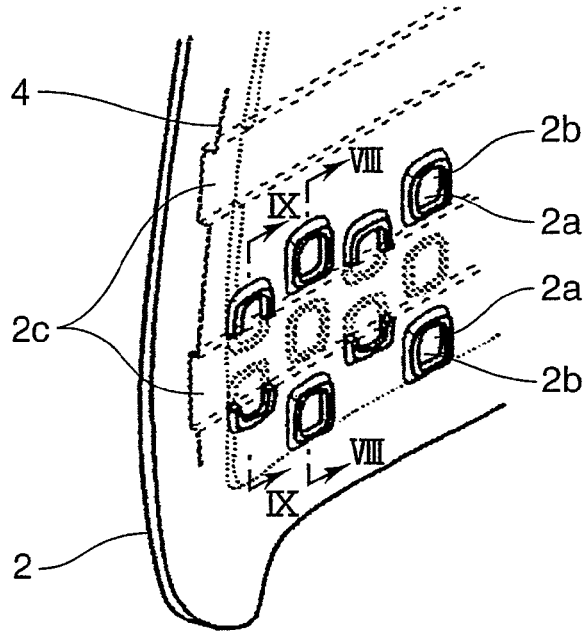
FIG. 7 is a schematic perspective view showing a deformation suppression section formed in the sheet material forming the outer blades shown in FIGS. 1A and 1B.
Figure 8:
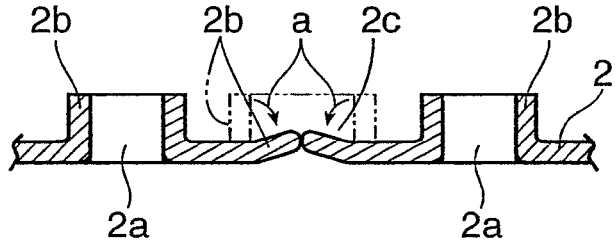
FIG. 8 is a sectional view taken on VIII-VIII line of FIG. 7.
Figure 9:
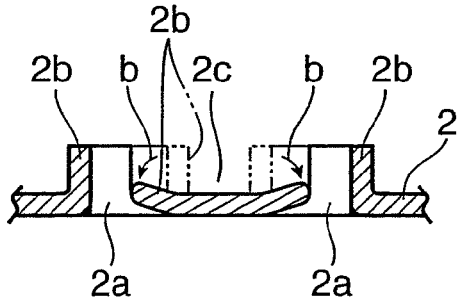
FIG. 9 is a sectional view taken on IX-IX line of FIG. 7.

The hair introduction holes 2*a* are arranged at a specified pitch in the longitudinal directions of the outer blade 1, i.e., (the directions shown by the arrow A of FIG. 2) while shifted by half the pitch from each other in the vertical directions of the outer blade 1, i.e., short-side directions (the directions shown by an arrow B of FIG. 2), as shown in FIG. 7. In other words, the hair introduction holes 2*a* are arranged in zigzag form in the directions shown by the arrow A (in the longitudinal directions of the outer blade).

Either of the outer blades 1A and 1B tends to have a deformation at the lower-end portions of the sheet material 2 forming the outer blade 1. Specifically, since the outer blade 1A is formed by bending the sheet material 2 originally shaped like a flat plate into a reverse-U shape (curved line projecting upward) in lateral view (i.e., in the first directions) and the outer blade 1B is formed by bending the sheet material 2 originally shaped like a flat plate into a reverse-U shape (curved line projecting upward) and into a shape curved in an arc in front view (i.e., in the first directions and in the second directions different from the first directions), each bending produces surpluses of the material in both lower-end portions respectively, which is likely to produce a deformation such as wrinkles or an undulation.

In order to suppress the deformation, either of the outer blades 1A and 1B is formed with a deformation suppression section 2*c* in a specific region within the regions L2 of the sheet material 2, specifically, in each of a plurality of specific regions not including the projection sections 2*b* which make contact with the inner blade 3 but including the projection sections 2*b* which make no contact with the inner blade 3. Each deformation suppression section 2*c* is a section where the projection sections 2*b* are crushed by pressing from the inside of the sheet material 2.

The shapes and the number of the deformation suppression sections 2*c* and the degree to which the projection sections 2*b* included in the deformation suppression sections 2*c* are crushed may be suitably set. In the example shown in FIGS. 7 to 9 and 11, the projection sections included in the deformation suppression sections 2*c* are crushed by a length less than the original projection height thereof in such a way that each projection section 2*b* inclines by a predetermined angle radially inwardly, leaving a part of the inward projection of each projection section 2*b*.

In the example of FIGS. 7 to 9 and 11, a plurality of deformation suppression sections 2*c* extending in the longitudinal directions of the outer blade (shown by the arrow A) are formed in a plurality of positions aligned vertically, respectively, each having a width (a vertical dimension) substantially equal to the vertical dimension of a single projection section 2*b*. Since the hair introduction holes 2*a* and the projection sections 2*b* corresponding to the peripheral edge thereof according to this embodiment are arranged in zigzag form as described above, the deformation suppression sections 2*c* include the projection sections 2*b* crushed over the whole thereof shown by an arrow a of FIG. 8 and the projection sections 2*b* crushed partly only in the upper or lower part thereof shown by an arrow b of FIG. 9.

In this example, the suitable width (vertical dimension) of each deformation suppression section 2*c* is approximately 0.4 mm and the suitable distance in the vertical directions (shown by the arrow B) between each deformation suppression section 2*c* is approximately 0.8 mm. The number of the deformation suppression sections 2*c*, which is three in the figures, may be two or below, or four or above.

Figure 12A:
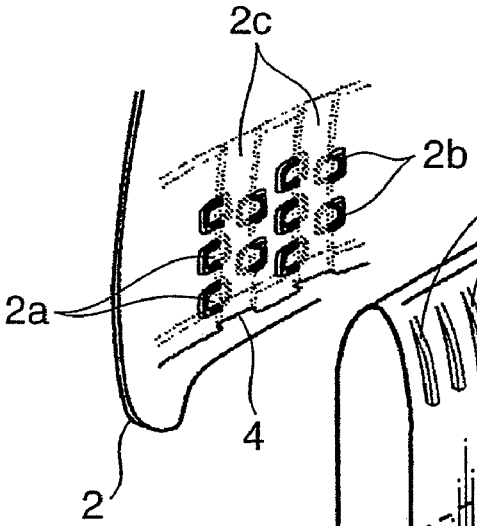
FIG. 12A is a perspective view showing a main part of an outer blade formed with a deformation suppression section extending laterally and FIG. 12B is a perspective view of the punch for shaping the outer blade of FIG. 12A, which punch has vertical ribs for forming the deformation suppression section.

As another example, FIG. 12 shows a sheet material 2, which is formed with a plurality of deformation suppression sections 2*c* extending vertically in a plurality of rows arranged in the longitudinal directions of the outer blade (shown by the arrow A), respectively. Also in this case, the suitable width (lateral dimension) of each deformation suppression section 2*c* is approximately 0.4 mm and the suitable lateral distance between each deformation suppression section 2*c* is approximately 0.8 mm. The sheet material 2 shown in FIG. 12 is faulted with thirteen deformation suppression sections 2*c*, but the number of the deformation suppression sections 2*c* may be twelve or below, or fourteen or above.

In addition, the extending direction of deformation suppression sections are not limited to the lateral or vertical directions, but may be oblique directions.

In FIGS. 7, 11 and 12, a solid line 4, though indicating channels, is merely drawn for convenience of showing where the deformation suppression sections 2*c* is formed, not meaning that the channels should be actually formed in the inner surface of the sheet material 2.

In either outer blade, the crush of some or all of the projection sections 2*b* included in the deformation suppression sections 2*c* of the sheet material 2, which make no contact with the inner blade 3, by pressing them from the inside, causes a residual stress. The residual stress braces lower-end portions of the sheet material 2 forming the outer blade 1A (1B) to rigidify them, thereby suppressing a deformation such as wrinkles or an undulation in the lower-end portions. Besides, the pressing for forming the deformation suppression sections 2*c* does not affect the shape of the outer surfaces of the outer blade 1A (1B) (in FIGS. 1A and 1B, the shape of each deformation suppression section 2*c* is shown by a broken line, but the shape cannot be seen from the outside of the outer blade 1A (1B)), which improves the appearance of the outer blade 1A (1B). Furthermore, there is no need to add a deformation prevention plate as a separate component provided like a conventional outer blade, which involves no increase in cost.

Next will be described a method of producing the outer blade 1A and the outer blade 1B.

First is formed a sheet material 2 having a flat-plate shape shown in FIGS. 4 to 6. The sheet material 2 is provided with numerous hair introduction holes 2*a*, each peripheral edge of which forms a projection section 2*b* projecting inward.

Figure 10:
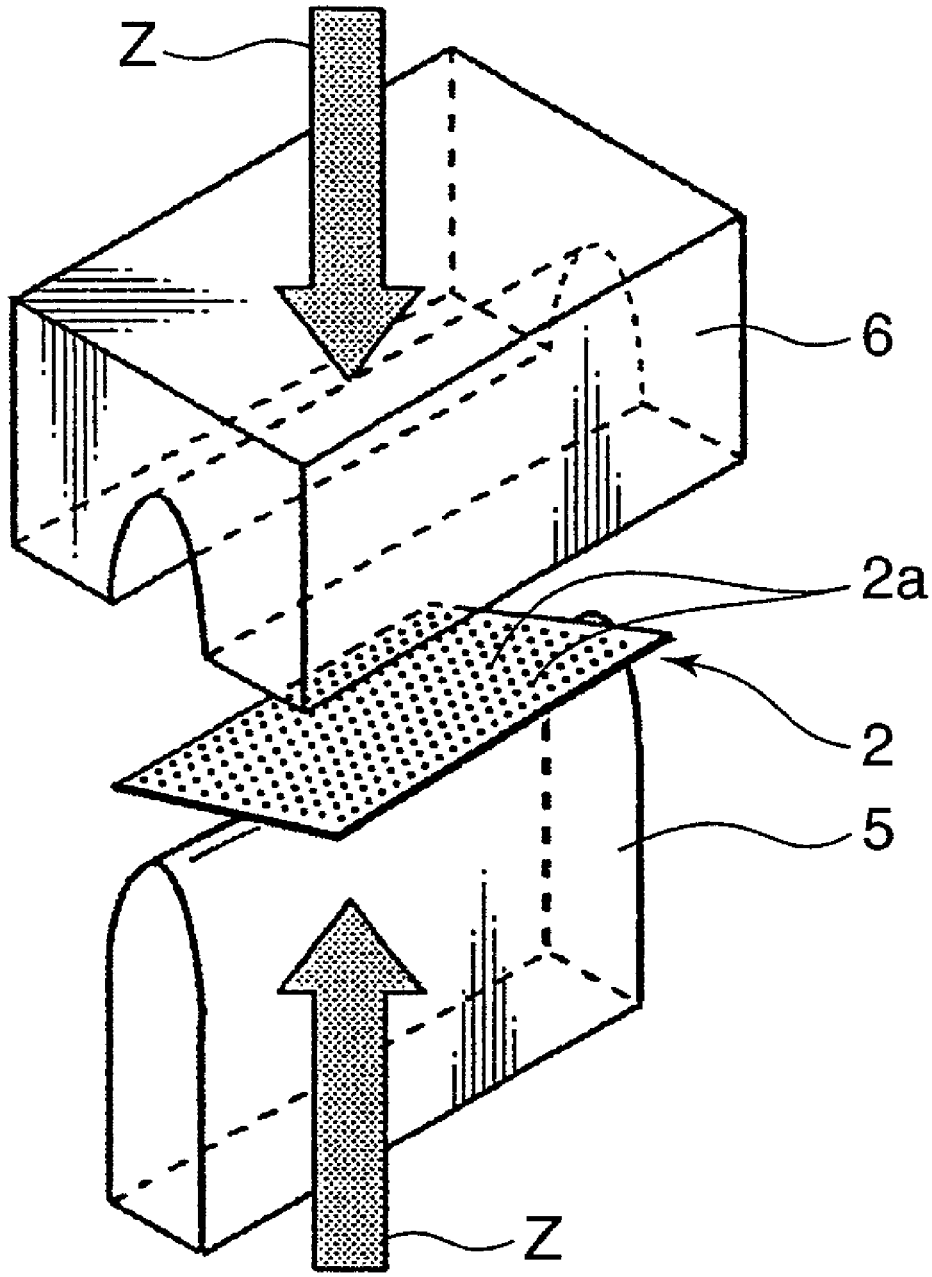
FIG. 10 is a perspective view showing a punch and a die for bending the sheet material.

Next, the sheet material 2 is bent into a shape projecting upward, using a punch 5 and a die 6 for pressing shown in FIG. 10, for example. The punch 5 has an outer surface shape corresponding to the inner-surface shape of the outer blade 1 and the die 6 has an inner surface shape corresponding to the outer surface shape of the outer blade 1. The sheet material 2 is placed between the punch 5 and the die 6, as shown by arrows Z of FIG. 10, to be pressed from above and below, thereby formed into a target outer-blade shape.

If the ridge part of the punch 5 and the valley part of the die 6 are both straight in front view, formed is an outer blade 1A of the type shown in FIG. 1A, which is formed of the sheet material 2 bent only in the first directions. On the other hand, if the punch 5 and the die 6 have a ridge part and a valley part, respectively, curved in an arc in front view, formed is an outer blade 1B of the type having an upper edge curved in an arc in front view shown in FIG. 1B, which is formed of the sheet material 2 bent in both the first and second directions. Differently from this, the method of producing the latter outer blade 1B may include pressing for bending the sheet material 2 in the first directions and pressing for bending the sheet material 2 in the second directions separately.

Figure 11A:
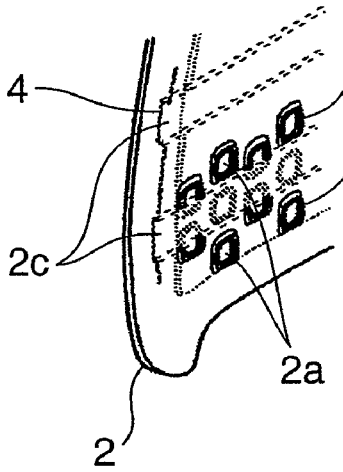
FIG. 11A is a perspective view showing a main part of an outer blade formed with a deformation suppression section extending laterally and FIG. 11B is a perspective view of the punch for shaping the outer blade of FIG. 11A, which punch has lateral ribs for forming the deformation suppression section.
Figure 11B:
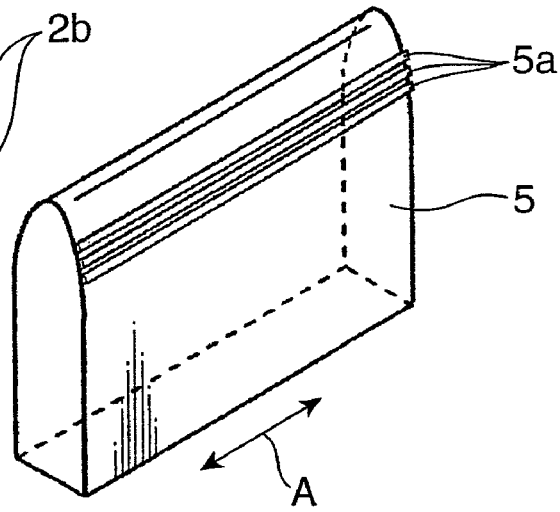

In the above bending (pressing), using a punch having an outer surface given respective ribs corresponding to the deformation suppression sections 2*c* as the punch 5 enables the punch 5 to also serve as a jig for forming a deformation suppression section, which allows the deformation suppression sections 2*c* to be formed simultaneously with the bending also functions. For example, in order to form the sheet material 2 into a shape having deformation suppression sections 2*c* extending in the lateral directions shown by the arrow A in FIG. 11A, the outer surface of the punch 5 may be given a plurality of ribs 5*a* each of which extends in a longitudinal direction of the outer blade corresponding to each deformation suppression section 2*c* as shown in FIG. 11B. Likewise, in order to form the sheet material 2 into a shape having deformation suppression sections 2*c* extending in the vertical directions shown by the arrow B in FIG. 12A, the outer surface of the punch 5 may be formed with a plurality of ribs 5*b* each of which extends in the vertical directions B corresponding to each deformation suppression section 2*c* as shown in FIG. 12B.

Figure 12B:
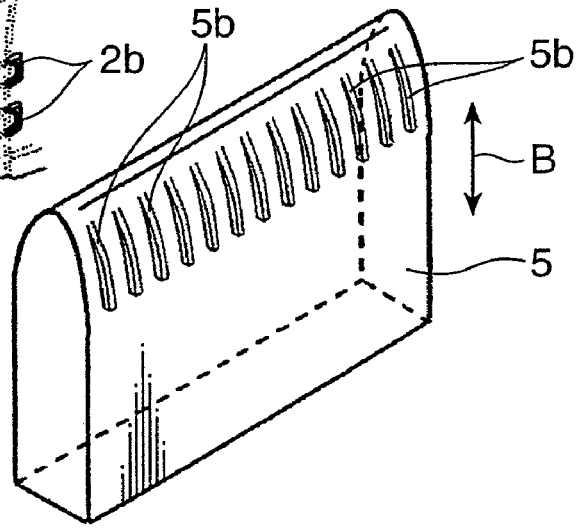

Using the punch 5 of FIG. 11B or FIG. 12B make it possible to form the deformation suppression sections 2*c* (e.g., to crush the projection sections 2*b* included in the deformation suppression sections 2*c*) simultaneously with bending the sheet material 2, thereby improving production efficiency of the outer blade. However, the deformation suppression sections 2*c* also may be formed in isolation by a punch and a die for exclusive use after the bending of the sheet material 2 (bending in the first directions or in the first and second directions).

As described so far, the present invention provides an outer blade for a reciprocation-type electric shaver and a method of producing the outer blade. The outer blade is formed of a sheet material bent into a shape projecting upward when viewed in the lateral directions. The sheet material has hair introduction holes through the sheet material in the thickness directions thereof, the peripheral edge of each hair introduction hole forms a projection section projecting inward beyond the other portion of the sheet material, and a part of the projection sections make contact with an inner blade of the reciprocation-type electric shaver reciprocating to cut a hair inserted through the corresponding hair introduction hole.

In addition, the sheet material is formed with a deformation suppression section in a specific region not including the projection sections which make contact with the inner blade but including the projection sections which make no contact with the inner blade. The deformation suppression section extends in a direction, and the projection sections included in the deformation suppression section are crushed by pressing from the inside of the sheet material. This causes a residual stress in the sheet material to rigidify lower-end portions of the sheet material, suppressing a deformation such as wrinkles or an undulation in the lower-end portions. Besides, the formation of the deformation suppression sections has little effect on the shape of the outer surface of the outer blade, which permits an improvement of the appearance of the outer blade. Furthermore, the suppressing of the deformation requires no addition of a separate component, not involving an increase in cost due to the addition of the component.

The projection sections may be so crushed as to leave a part of the inward projection thereof. For example, the projection sections may be so crushed as to incline radially inwardly by a predetermined angle.

In case that the end surfaces of the projection sections within a region including a vertex portion of the sheet material in the outer blade makes contact with the inner blade, the deformation suppression section may be formed within a region near both lower-end portions of the sheet material other than the above region. This effectively suppresses deformations especially in both lower-end portions.

In the present invention, more desirably, a plurality of deformation suppression sections may be spaced perpendicularly to directions in which the deformation suppression sections extend, thereby further enhancing the effect on deformation suppression. Specifically, it is preferable that the deformation suppression sections extend laterally of the outer blade and are spaced vertically of the outer blade, or that the deformation suppression sections extend vertically of the outer blade and are spaced laterally of the outer blade.

The present invention can be effectively applied also to the outer blade in which the sheet material has an upper-edge portion curved in an arc when viewed from the front thereof.

In the method of producing an outer blade according to the present invention, it is preferable that the process of forming a deformation suppression section, for example, includes pressing the inner surface of the sheet material against a jig having an outer surface formed with a rib in a shape corresponding to the shape of the deformation suppression section to thereby let the rib press a specific projection section of the sheet material from the inside to crush it. This method permits an efficient formation of the deformation suppression section.

Furthermore, in the process of bending the sheet material into a shape projecting upward when viewed laterally, the bending may be conducted through pressing using a punch having an outer surface in a shape corresponding to the shape of the inner surface of the outer blade and a die having an inner surface in a shape corresponding to the shape of the outer surface of the outer blade, the rib being formed on the outer surface of the punch. This enables the sheet material to be formed with the deformation suppression section simultaneously with the pressing, by using the rib, thereby establishing more efficient production of the outer blade.

In this case, the punch may be preferably formed with a plurality of ribs on its outer surface, the ribs spaced perpendicularly to directions in which the ribs extend. Specifically, the punch having an outer surface on which a plurality of ribs extending laterally are spaced vertically or a plurality of ribs extending vertically are spaced laterally is suitable.

The present invention is especially effective in case of bending the sheet material into a shape having an upper-edge portion thereof curved in an arc when viewed from the front. Since this bending may increase a surplus of the material in lower-end portions of the sheet material to promote the deformation further, forming the deformation suppression section in the sheet material is effective.

The invention claimed is:

1. An outer blade for a reciprocation-type electric shaver which includes the outer blade and an inner blade reciprocating inside of the outer blade, the outer blade comprising:

a sheet material, which forms the outer blade, bent into a shape projecting upward when viewed in lateral directions;

the sheet material having hair introduction holes through the sheet material in thickness directions thereof, the peripheral edge of each hair introduction hole forming a projection section projecting inward beyond a thickness of the sheet material and terminating at a free end thereof, a part of the projection sections each having a shape in which the free end of the projection section makes contact with the inner blade of the reciprocation-type electric shaver reciprocating to cut a hair inserted through the corresponding hair introduction hole; and the sheet material is formed with a deformation suppression section extending in a direction in a specific region that includes the projection sections which make no contact with the inner blade and do not include the projection sections which make contact with the inner blade, and the projection sections included in the deformation suppression section are crushed by pressing from the inside of the sheet material.

2. The outer blade for a reciprocation-type electric shaver according to claim 1, wherein the projection sections included in the deformation suppression section are so crushed as to leave a part of the inward projection of each projection section.

3. The outer blade for a reciprocation-type electric shaver according to claim 2, wherein the projection sections included in the deformation suppression section are so crushed as to incline radially inwardly thereof by a predetermined angle.

4. The outer blade for a reciprocation-type electric shaver according to claim 1, wherein the free ends of the projection sections within a region including a vertex portion of the sheet material in the outer blade makes contact with the inner blade, while the deformation suppression section is formed within a region near both lower-end portions of the sheet material other than the region including the vertex portion.

5. The outer blade for a reciprocation-type electric shaver according to claim 1, wherein a plurality of deformation suppression sections are spaced perpendicularly to directions in which the deformation suppression sections extend.

6. The outer blade for a reciprocation-type electric shaver according to claim 5, wherein the deformation suppression sections extend in a longitudinal direction of the outer blade and are spaced in a vertical direction of the outer blade.

7. The outer blade for a reciprocation-type electric shaver according to claim 5, wherein the deformation suppression sections extend in a vertical direction of the outer blade and are spaced in a longitudinal direction of the outer blade.

8. The outer blade for a reciprocation-type electric shaver according to claim 1, wherein the sheet material has an upper-edge portion curved in an arc when viewed from the front thereof.

9. A method of producing an outer blade for a reciprocation-type electric shaver which includes the outer blade and an inner blade reciprocating inside of the outer blade, comprising:

a process of producing a sheet material for forming the outer blade, the sheet material having hair introduction holes through the sheet material in the thickness directions thereof, the peripheral edge of each hair introduction hole forming a projection section projecting inward beyond a thickness of the sheet material;

a process of bending the sheet material into a shape projecting upward when viewed in lateral directions; and a process of forming a deformation suppression section for suppressing a deformation of the lower end of the sheet material, the deformation suppression section being formed in a specific region of the sheet material that includes the projection sections which make no contact with the inner blade and does not include the projection sections which make contact with the inner blade of the reciprocation-type electric shaver, wherein, in the process of forming the deformation suppression section, the projection sections included in the deformation suppression section are crushed by pressing from the inside of the sheet material.

10. The method of producing an outer blade for a reciprocation-type electric shaver according to claim 9, wherein, in the process of forming the deformation suppression section, the projection sections included in the deformation suppression section are partially crushed so as to leave a part of the inward projection of each projection section.

11. The method of producing an outer blade for a reciprocation-type electric shaver according to claim 10, wherein the projection sections included in the deformation suppression section are so crushed as to incline radially inwardly thereof by a predetermined angle.

12. The method of producing an outer blade for a reciprocation-type electric shaver according to claim 10, wherein, in the process of forming the deformation suppression section, the inner surface of the sheet material is pressed against a jig having an outer surface formed with a rib in a shape corresponding to the shape of the deformation suppression section to thereby let the jig press a specific projection section of the sheet material from the inside to crush it.

13. The method of producing an outer blade for a reciprocation-type electric shaver according to claim 12, wherein, in the process of bending the sheet material into a shape projecting upward when viewed in the lateral directions, the bending is conducted through pressing using a punch having an outer surface in a shape corresponding to the shape of the inner surface of the outer blade and a die having an inner surface in a shape corresponding to the shape of the outer surface of the outer blade, the rib being formed on the outer surface of the punch to form the deformation suppression section in the sheet material simultaneously with the pressing.

14. The method of producing an outer blade for a reciprocation-type electric shaver according to claim 13, wherein the punch is formed with a plurality of ribs on the outer surface thereof, the ribs spaced perpendicularly to directions in which the ribs extend.

15. The method of producing an outer blade for a reciprocation-type electric shaver according to claim 14, wherein the ribs extend longitudinally and are spaced vertically on the outer surface of the punch.

16. The method of producing an outer blade for a reciprocation-type electric shaver according to claim 14, wherein the ribs extend vertically and are spaced longitudinally on the outer surface of the punch.

17. The method of producing an outer blade for a reciprocation-type electric shaver according to claim 9, wherein the sheet material is bent into a shape having an upper-edge portion curved in an arc when viewed from the front.

* * * * *